US012514414B2

(12) United States Patent
Conrad, III et al.

(10) Patent No.: US 12,514,414 B2
(45) Date of Patent: Jan. 6, 2026

(54) BRACKET FOR ATTACHING A POTTY-TRAINING DEVICE TO TOILET SEAT

(71) Applicant: FOR KIDS BY PARENTS, INC., Potomac, MD (US)

(72) Inventors: Joseph Michael Conrad, III, Potomac, MD (US); Raphael John Conrad, Potomac, MD (US)

(73) Assignee: FOR KIDS BY PARENTS, INC., Potomac, MD (US)

( * ) Notice: Subject to any disclaimer, the term of this patent is extended or adjusted under 35 U.S.C. 154(b) by 106 days.

(21) Appl. No.: 18/565,919

(22) PCT Filed: Jun. 1, 2022

(86) PCT No.: PCT/US2022/031769
§ 371 (c)(1),
(2) Date: Nov. 30, 2023

(87) PCT Pub. No.: WO2022/256406
PCT Pub. Date: Dec. 8, 2022

(65) Prior Publication Data

US 2024/0252003 A1 Aug. 1, 2024

Related U.S. Application Data

(60) Provisional application No. 63/195,791, filed on Jun. 2, 2021.

(51) Int. Cl.
*A47K 13/24* (2006.01)
*E03D 9/00* (2006.01)

(52) U.S. Cl.
CPC ..... *A47K 13/24* (2013.01); *E03D 9/00* (2013.01)

(58) Field of Classification Search
CPC ..... A47K 13/24; A47K 17/00; E03D 9/00; E03D 13/005
(Continued)

(56) References Cited

U.S. PATENT DOCUMENTS 1,109,904 A 9/1914 Dahlgren
7,870,619 B2 1/2011 Conrad, III et al.
(Continued)

FOREIGN PATENT DOCUMENTS

CA 2622644 C * 3/2013 ..... A47K 13/005
JP 3160605 U 7/2010
(Continued)

OTHER PUBLICATIONS

International Search Report dated Aug. 12, 2022, in connection with PCT Application No. PCT/US2022/031769.
(Continued)

*Primary Examiner* — Lori L Baker
(74) *Attorney, Agent, or Firm* — Norris McLaughlin, P.A.

(57) ABSTRACT

A bracket for securing a potty-training device to the underside of a toilet seat, wherein the potty-training device is made of a flexible material, has a flat configuration comprising a plurality of attachment tabs, a urine deflecting surface and a folding seam positioned between and connected to the plurality of attachment tabs on one side and the urine deflecting surface on the other side of the folding seam; or the potty-training device is made of a flexible material, has an L-shaped configuration and comprises a plurality of attachment tabs and a urine deflecting surface, wherein the plurality of attachment tabs are positioned and fixed at a right angle to the urine deflecting surface; where the bracket matches the inner curvature of a toilet seat and
(Continued)

eliminates the need for the potty-training device to require an adhesive to attach the potty-training device to the toilet seat.

17 Claims, 8 Drawing Sheets

(58) Field of Classification Search
USPC ..... 4/300.3, 300, 415; 210/85, 521; 239/461, 518
See application file for complete search history.

(56) References Cited

U.S. PATENT DOCUMENTS 8,881,319 B2 * 11/2014 Schuster ..... E03D 1/304 4/324
8,984,674 B1 * 3/2015 Harris ..... A61F 5/451 4/300.3
10,925,445 B1 * 2/2021 Garcia ..... A47K 11/12
11,103,112 B1 * 8/2021 Jasmin ..... A47K 11/02
11,661,731 B2 * 5/2023 Ferreira ..... E03D 9/00 4/300.3
11,737,619 B2 * 8/2023 Braun ..... E03D 9/00 4/300.3
2008/0016607 A1 1/2008 Cottage
2011/0030134 A1 * 2/2011 Dubiel ..... A47K 11/06 4/237
2012/0084908 A1 * 4/2012 Dunn ..... E03D 9/007 4/222
2012/0084909 A1 * 4/2012 Dunn ..... A47K 11/06 4/483
2013/0097771 A1 * 4/2013 Smith ..... A47K 13/06 4/237
2013/0263369 A1 * 10/2013 Embler ..... A47K 13/105 4/246.3
2014/0101835 A1 * 4/2014 Notman ..... E03D 9/00 4/300.3
2014/0259338 A1 * 9/2014 Welch ..... A47K 13/06 4/239
2015/0330066 A1 * 11/2015 Marra ..... E03D 9/00 4/300.3
2016/0108609 A1 * 4/2016 Escudero ..... E03D 9/00 4/300.3
2016/0360938 A1 * 12/2016 Mulford ..... A47K 17/028
2017/0164796 A1 * 6/2017 Fang ..... A47K 13/06
2017/0321409 A1 * 11/2017 Pritchard ..... E03D 11/12
2019/0216276 A1 7/2019 Conrad et al.
2019/0261820 A1 8/2019 Conrad, III et al.
2021/0045593 A1 2/2021 Pang et al.
2021/0259485 A1 * 8/2021 Garcia ..... A47K 13/26

FOREIGN PATENT DOCUMENTS

WO WO-2014011352 A2 * 1/2014 ..... A47K 13/06
WO WO-2022256406 A1 * 12/2022 ..... A47K 13/24

OTHER PUBLICATIONS

Written Opinion dated Sep. 2, 2022, in connection with PCT Application No. PCT/US2022/031769.

* cited by examiner

BRACKET FOR ATTACHING A POTTY-TRAINING DEVICE TO TOILET SEAT

CROSS REFERENCE TO RELATED APPLICATIONS

This application is a 371 of International Patent Application No. PCT/US2022/031769, filed Jun. 1, 2022, which claims priority of U.S. Provisional Application Ser. No. 63/195,791, filed Jun. 2, 2021, the entire contents of which are hereby incorporated herein by reference.

STATEMENT REGARDING FEDERALLY SPONSORED RESEARCH

Not applicable.

FIELD OF THE INVENTION

This invention is directed to a bracket for attaching a potty-training device that functions to attach a urine-deflector to the underside of an adult sized toilet seat. The invention is designed to work specifically with the potty-training device described and claimed in U.S. Pat. No. 7,870,619; pending U.S. patent application Ser. Nos. 16/364,495 and 16/327,602; and their respective patent families, all of which are incorporated herein by reference. The potty-training device described in these patents and applications (hereinafter, optionally referred to as "prior art potty-training device" or "prior art device") is designed to block the opening formed between the toilet seat and the toilet bowl and reduces accidental wetting of clothing and the floor that occurs when a child's urine stream passes through the opening between the toilet seat and the toilet bowl. The prior art potty-training device requires a means for attaching it to the underside of a toilet seat, wherein the means is disclose as being an adhesive tape, more specifically a double-sided adhesive (hereinafter, optionally referred to as "tape"). The bracket of the present invention eliminates the need to use tape to attach the prior art potty-training device to the toilet seat.

BACKGROUND OF THE INVENTION

It is a major accomplishment for a child to reach the stage of sitting on an adult toilet during potty-training. Obtaining control over the direction of urine flow, however, may take some time for a child to master, particularly a male child. When sitting on the toilet, a child's urine stream is not always directed into the toilet. There are occasions where the child's urine stream finds its way out of the toilet through the opening formed between the toilet seat and the toilet bowl. This results in the urine stream coming in contact with the child's pants or other clothing and the floor. This can be very upsetting for a child who is trying to do their best to stay dry and master going to the toilet, as well as the parent who has to continually clean up the mess.

The prior art potty-training device effectively solved the problem of blocking the gap between the toilet seat and bowl; and the flexibility of the prior art device is a desirable commercial feature, that makes it compatible with both standard round and elongated toilet seats. The prior art potty-training device in one version, is made of a flexible material, has a flat configuration and comprises a plurality of attachment tabs, a urine deflecting surface and a folding seam positioned between and connected to the plurality of attachment tabs on one side and the urine deflecting surface on the other side of the folding seam. In another version, the prior art potty-training device is made of a flexible material, has no folding seam, has an L-shaped configuration and comprises a plurality of attachment tabs and a urine deflecting surface, wherein the plurality of attachment tabs are positioned and fixed at a right angle to the urine deflecting surface.

We recently determined that the material selected to make the commercial version (hereinafter, "product material") of the prior art device, which provides the desired flexibility to the device, in a small percentage of cases had difficulty adhering to the tape selected for this purpose. While a significant majority of the prior art devices would stay attached to the toilet seat for 3 to 6 months or longer, a small percentage would detach within a week. This premature detachment results in frustration for those consumers experiencing this situation, and/or required consumers to re-apply the tape to the prior art device and re-attach it to the toilet seat. This can also be a time consuming process for some consumers, creating additional frustration.

Consumer feedback from some seniors also indicated that they were having difficulty manipulating the tape because they lacked the motor-skills needed to remove the tape liner or reapply the tape to the prior art device, if needed.

In order to find a solution to the above-described challenges, changing the tape to one more compatible with the product material was pursued, but no other commercially available tape performed better than the tape currently being used. Consideration was also given to changing the product material to one more compatible with available tape options, but it was determined that doing so would compromise the desirable flexibility of the prior art device.

Since the tape appeared to be the primary source of frustration for a small percentage of consumers, consideration was also given to ways of attaching the prior art device to the toilet seat, without the need to use tape on the prior art device's product material. It was from this approach that the "bracket" of the present invention was conceived.

BRIEF SUMMARY OF THE INVENTION

The bracket of the present invention is specifically designed to work with the prior art device and provides a tape free experience for the consumer (as it pertains to the prior art device), eliminates the occurrence of the prior art device detaching from the toilet seat, and preserves the desired flexibility of the prior art device. The bracket also provides for an easier and quicker prior art device attachment process. Once the bracket is in place, the prior art device can be easily inserted into and removed from the bracket for cleaning or replacement.

The bracket is preferably made from a plastic material but can be made of any material that results in the bracket having a rigid configuration. In one embodiment of the invention the bracket is molded into a fixed configuration that matches the inner curvature of either a standard round or elongated toilet seat. More specifically, the bracket's fixed curvature is complimentary to the seat's inner curvature and holds the prior art device's curvature in the same complimentary configuration when the prior art device is engaged with the bracket.

In another embodiment of the invention, while the bracket has the same rigid characteristics described in the previous embodiment, the bracket is configured to match the inner curvature of a standard round toilet seat, has a left half and a right half that are separated by, and attached to, a hinge member. The hinge member allows each half to bend enough to conform to the inner curvature of an elongated toilet seat. Therefore, for this embodiment, a single bracket can accommodate the configuration of both a round and an elongated toilet seat. By contrast, the bracket described in the prior embodiment is manufactured in two separate configurations, one for a round seat and the other for an elongated seat.

Both bracket embodiments require a means for attaching them to the underside of the toilet seat. The means for attaching the bracket to the seat may be selected from any suitable adhesive material. Suitable adhesive materials include, but are not limited to, double-sided adhesive tape or a liquid or gel-type adhesive. The preferred suitable adhesive for the bracket is a double-sided adhesive tape. Any selected adhesive must be water resistant and compatible with the material used to make the bracket, such that it has a high bonding strength when applied to the selected product material and the toilet seat surface.

DETAILED DESCRIPTION OF THE INVENTION

Figure 1:
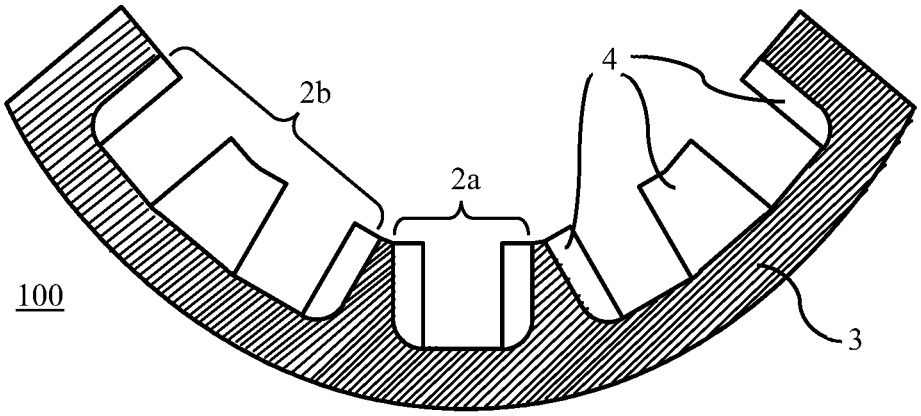
FIG. 1 is a top-down view of the "bottom side" of the bracket of the $1^{st}$ embodiment.
Figure 7:
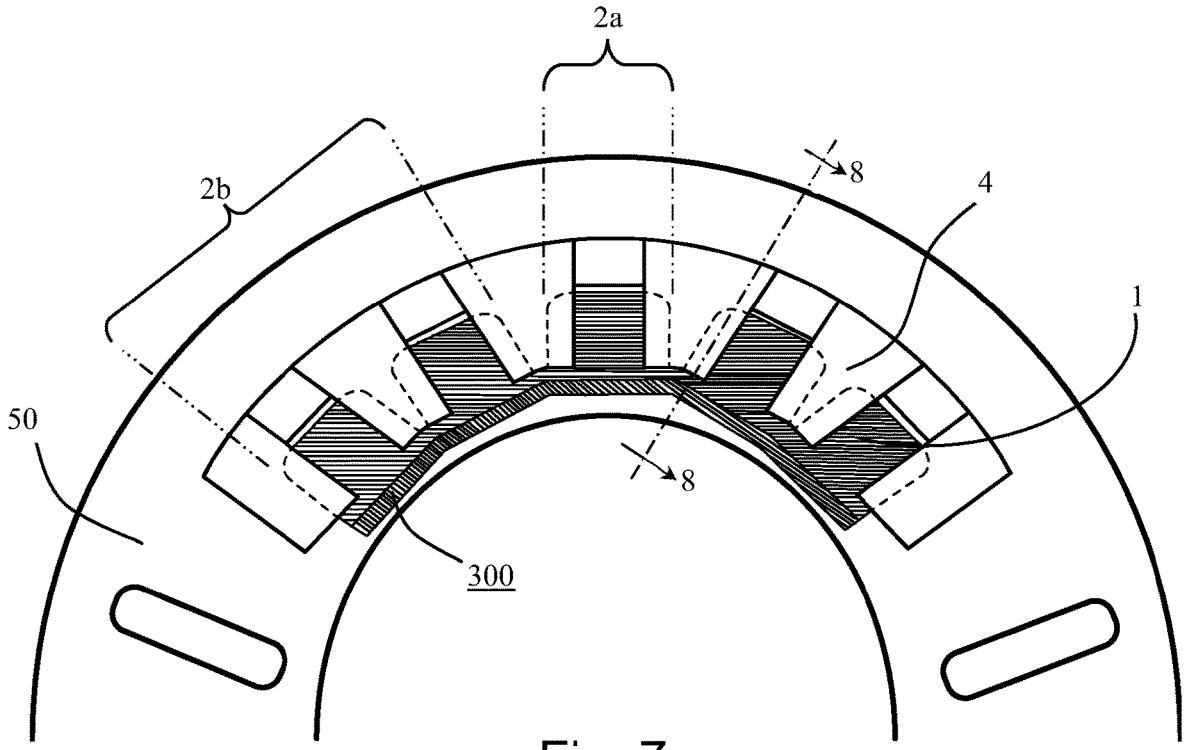
FIG. 7 is a top-down view of the bracket of the $1^{st}$ embodiment with the prior art device attached thereto depicted in FIG. 4, attached to the underside of a toilet seat.

In a $1^{st}$ embodiment, as depicted in FIG. 7, the present invention is directed to a bracket 100 for securing a prior art potty-training device 300 to the underside of a toilet seat 50. More specifically, the bracket 100 is designed to secure the prior art device's plurality of attachment tabs against the underside of the toilet seat. In FIG. 1, the bottom view of the bracket 100 comprises a plurality of slots 2, more specifically, a center slot 2*a* that receives a single attachment tab from the prior art device, and two larger slots 2*b*, on the left side (left of center) and right side (right of center) of center slot 2*a*, to receive a plurality of attachment tabs from the prior art device. Each slot 2 has a depth that accommodates the thickness of the attachment tabs of the prior art device, so that when the bracket 100 is attached to the toilet seat with an adhesive material 3 adhered to the bottom surface of bracket 100, the plurality of attachment tabs inserted into slots 2*a* and 2*b*, are flush against the surface of the toilet seat. Also shown in FIG. 1 is a bottom surface of a plurality of tab covers 4, which are in contact with the top surface of the attachment tabs, when the attachment tabs are in their respective slots 2.

Figure 2:
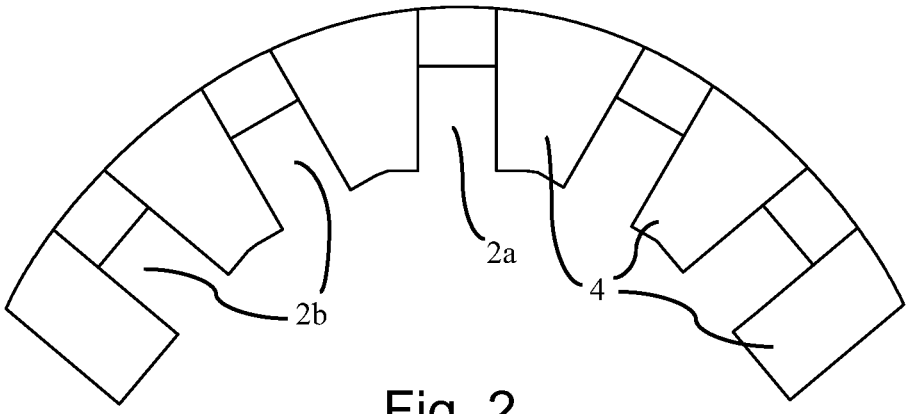
FIG. 2 is a top-down view of the "top side" of the bracket of the $1^{st}$ embodiment.

FIG. 2 shows a top view of bracket 100, showing the plurality of tab covers 4. As shown, the plurality of tab covers 4 are segmented and partially cover the slots 2. Alternatively, the plurality of tab cover 4 can be a contiguous non-segmented component that completely covers slots 2. Regardless of whether the tab covers 4 are segmented or contiguous, they function to apply vertical pressure to the top surface of the plurality of attachment tabs of the prior art device, thereby pressing the bottom surfaces of the plurality of attachment tabs against the toilet seat, resulting in the prior art device being held in place on the toilet seat.

Figure 3:
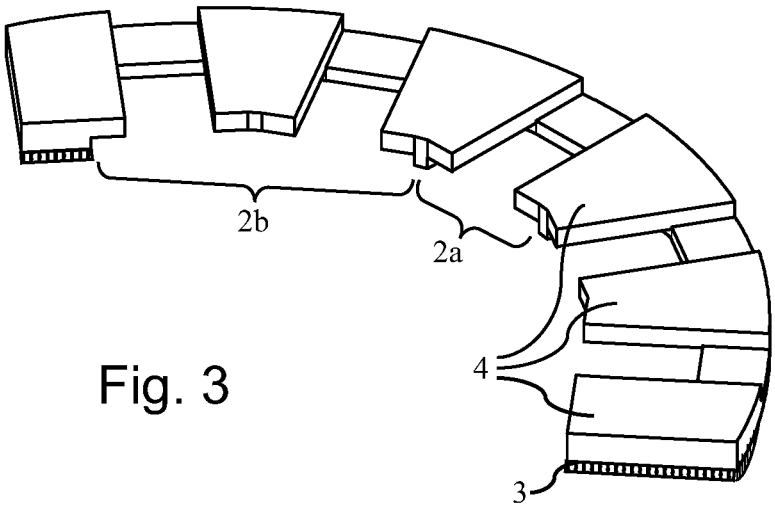
FIG. 3 is a plan view of the bracket of the $1^{st}$ embodiment.
Figure 4:
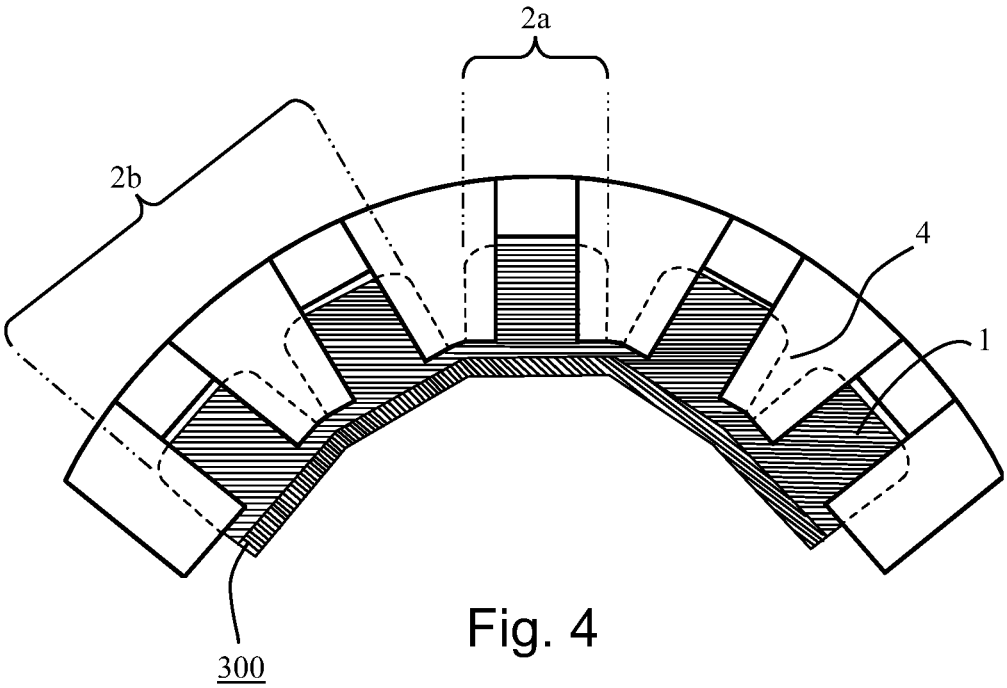
FIG. 4 is a top-down view of the bracket of the $1^{st}$ embodiment, with the prior art device attached thereto.

In FIG. 3, slots 2*a* and 2*b* receive the prior art device's plurality of attachment tabs, which slide into slots 2 and underneath the plurality of tab covers 4. The pressure exerted on the plurality of attachment tabs by the tab covers 4, is sufficient to hold the prior art device in place until physically removed by the consumer. FIG. 4 shows a top view of prior art device 300 inserted into bracket 100, with the plurality of attachment tabs 1 inserted into their respective slots 2*a* and 2*b*.

Figure 5:
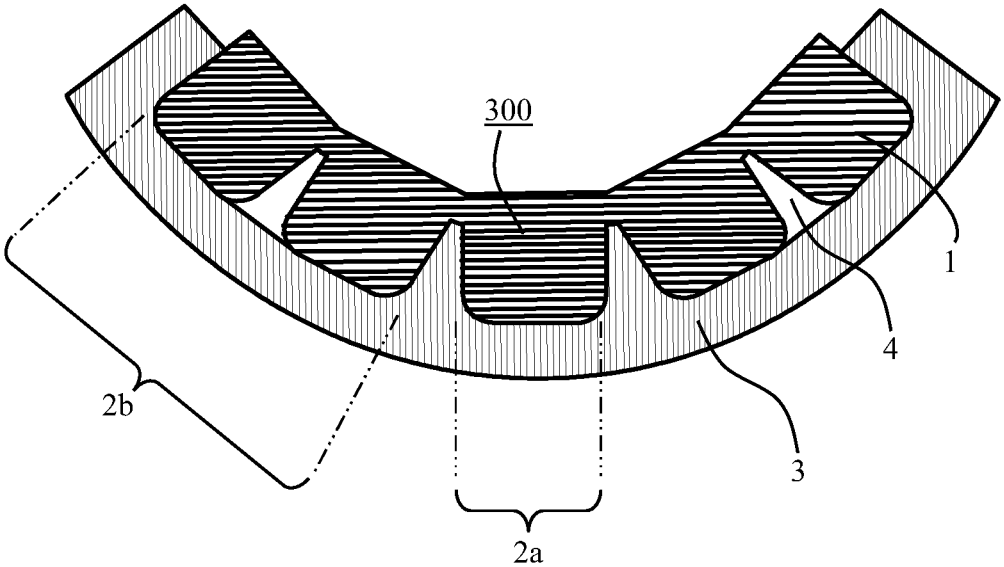
FIG. 5 is a top-down view of "bottom side" of the bracket of the $1^{st}$ embodiment, with the prior art device attached and showing the orientation of the prior art device attachment tabs interacting therewith.

FIG. 5, shows the bottom view of prior art device 300 engaged with bracket 100, wherein the plurality of attachment tabs 1 are positioned in their respective slots 2*a* and 2*b* on the bracket 100. This orientation shows the face of both the bracket 100 and attachment tabs 1 that are in contact with the toilet seat. The plurality of attachment tabs 1 do not have any adhesive on its surface, while the bracket 100 has adhesive 3 applied to its bottom surface. The bottom surface of tab cover 4 is visible between the plurality of attachment tabs 1 in slots 2*b*.

Figure 6:
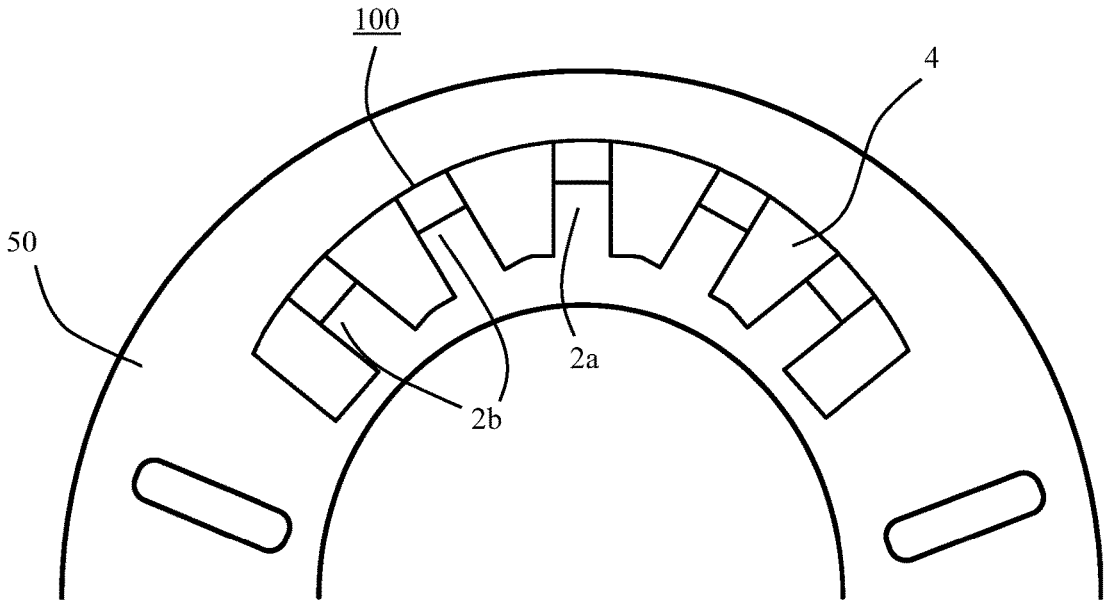
FIG. 6 is a top-down view of the bracket of the $1^{st}$ embodiment depicted in FIG. 2, attached to the underside of a toilet seat.

FIG. 6 shows a top view of bracket 100 attached to a bottom surface of toilet seat 50. The curved arrangement of each tab cover 4 functions as a visual reference point for aligning the bracket 100 along the inner curvature of the toilet seat 50. The center slot 2*a* also functions as a visual reference point for centering the bracket on the seat 50. FIG. 7 shows a top view of the prior art device 300 inserted into bracket 100, with the attachment tabs 1 covered by tab covers 4 and engaged with their respective slots 2*a* and 2*b*.

Both standard round and elongated toilet seats generally have consistent configurations and curvatures with minor variations from brand to brand. The brackets of the present invention are designed to match or approximate the inner curvature of either style toilet seat. The inner curvature of the respective toilet seats is defined by the radius-of-curvature at a point on the inner curvature at the front of the seat, that intersects a centerline of the seat along its length, from back to front. For example, a standard round toilet seat, can have a radius-of-curvature ranging from about 2.50 to 3.00 inches, preferably from about 2.70 to 2.86 inches, and most preferably about 2.75 to 2.80 inches. For an elongated seat, examples of the radius-of-curvature can range from about 1.44 to 1.76 inches, preferably from about 1.55 to 1.65 inches, and most preferably about 1.58 to 1.62 inches. Therefore, the radius-of-curvature for the brackets of the present invention match or approximate the radius-of-curvature of the respective seat to which it is attached.

Figure 8:
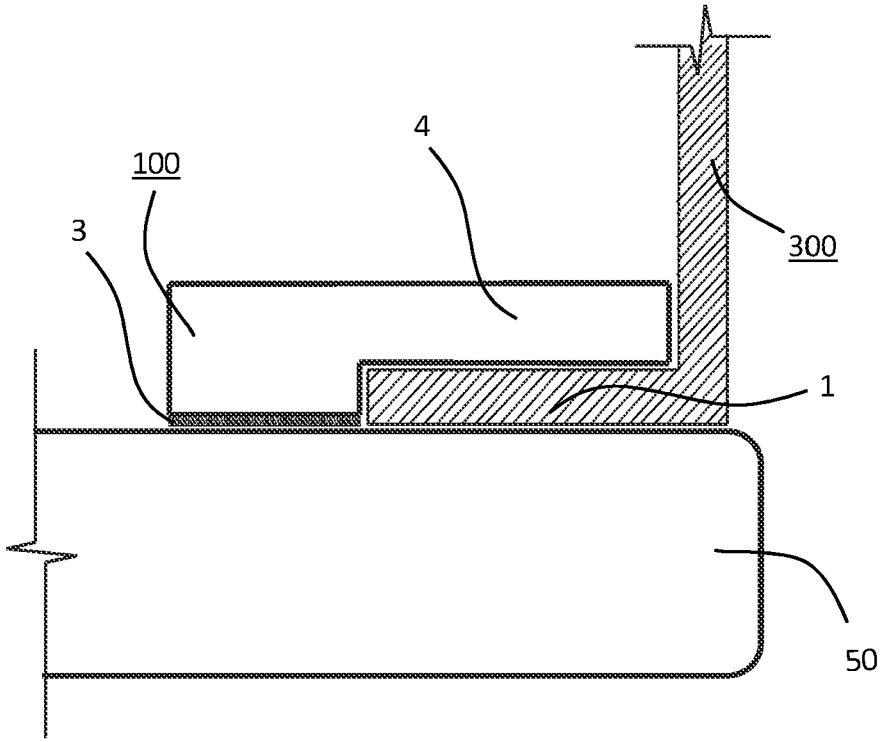
FIG. 8 is a cross-sectional side view of the $1^{st}$ embodiment with the prior art device attached thereto depicted in FIG. 7, attached to the underside of a toilet seat, where the bottom surface of the tab cover in contact with the prior art device attachment tab has a smooth surface.

FIG. 8 shows a cross-sectional side view of the bracket arrangement shown in FIG. 7, along drafting line 8. More specifically, FIG. 8 shows the bracket 100 attached to the bottom surface of toilet seat 50, by adhesive 3. The prior art device 300 attachment tab 1 is shown to be inserted into slot 2*a* (not labeled) under tab cover 4.

Figure 9:
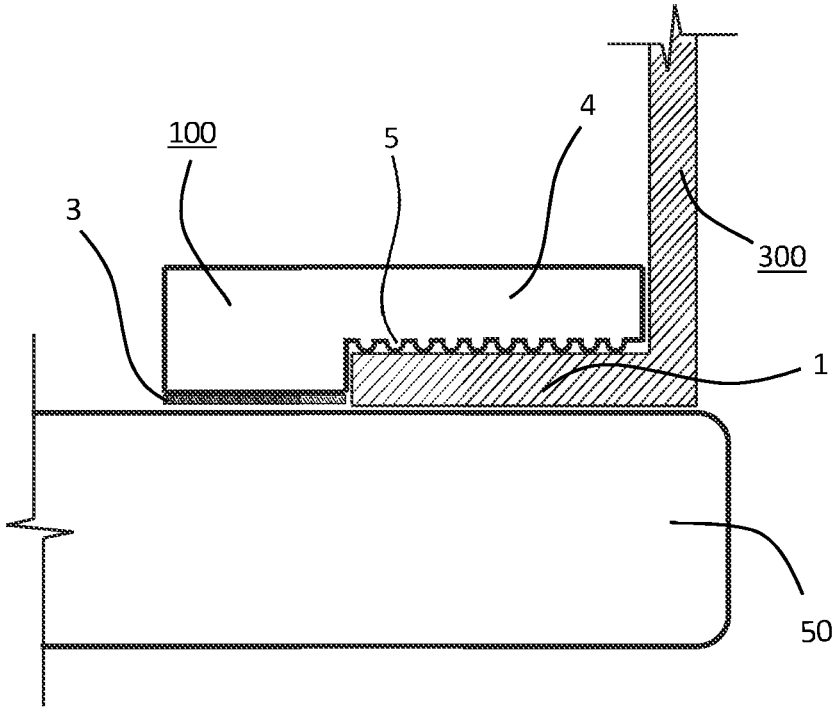
FIG. 9 is a cross-sectional side view of the $1^{st}$ embodiment with the prior art device attached thereto depicted in FIG. 7, attached to the underside of a toilet seat, where the bottom surface of the tab cover in contact with the prior art device attachment tab has a non-smooth surface.
Figure 10:
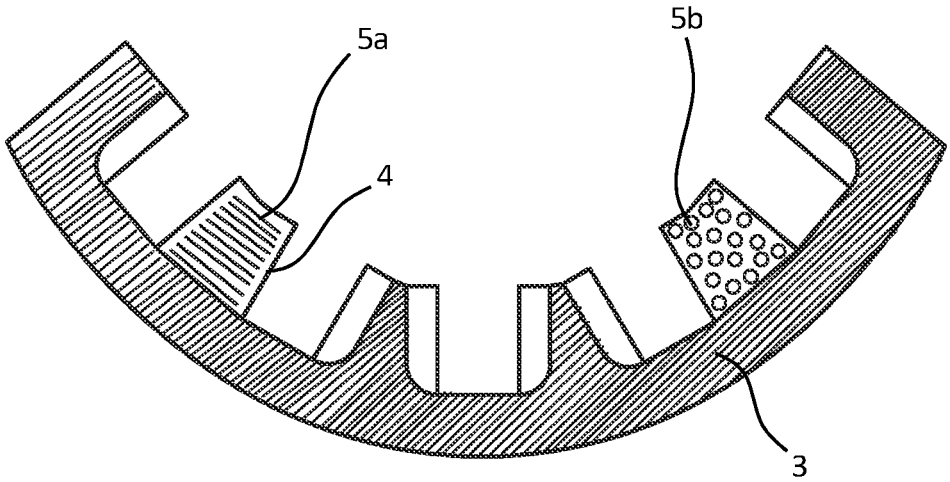
FIG. 10 is a top-down view of the "bottom side" of the bracket of the $1^{st}$ embodiment showing optional configurations of structural elements on the bottom face of a tab cover contributing to its non-smooth surface, as shown in FIG. 9.

Each tab cover 4 is positioned over and in contact with the plurality of attachment tabs 1, such that it creates a pressure fit, to securely hold the plurality of attachment tabs 1 between the bottom surface of tab covers 4 and the toilet seat 50. While the applied pressure can result from a tab cover 4 having a smooth bottom surface, as shown in FIG. 9, the bottom surface of the tab cover 4 can optionally have a non-smooth surface. More specifically, the bottom surface of tab cover 4 can have plurality of raised structures 5 that press down on the plurality of attachment tabs 1, to apply pressure to thereto. The plurality of raised structures 5 can have any configuration that exerts pressure against the attachment tabs 1 to hold it in place within the bracket 100 and against the toilet seat 50. For example, as shown in FIG. 10, the plurality of raised structures 5 can have a linear configuration (5*a*). Alternatively, the plurality of raised structures 5 can have array of spherical bumps (5*b*) on the underside of the plurality of tab covers 4. Those of ordinary skill in the art will recognize that the plurality of raised structures 5 can have any configuration or arrangement, so long as they provide vertical pressure to the top surface of the prior art device's 300 plurality of attachment tabs to securely hold it against the bottom surface of the toilet seat 50.

The above description for this $1^{st}$ embodiment is directed to a bracket 100 configured for either an elongated or standard round toilet seat 50.

In a $2^{nd}$ embodiment, the present invention is directed to a bracket having an adjustable curved configuration which conforms to the inner curvature of either an elongated or standard round toilet seat; and is designed to secure the prior art device's plurality of attachment tabs against the underside of the toilet seat. The bracket of this $2^{nd}$ embodiment is manufactured to match the curvature of a standard round toilet seat and can be manipulated to conform to the curvature of an elongated toilet seat by bending the bracket about a hinge member to change the curvature of the bracket.

The interaction of the prior art device 300 with the bracket of this $2^{nd}$ embodiment, is the same as the above-described interaction with the bracket 100 of the $1^{st}$ embodiment; that is the prior art device's 300 plurality of attachment tabs fit into the respective slots of both brackets 100 and 200.

Figure 11:
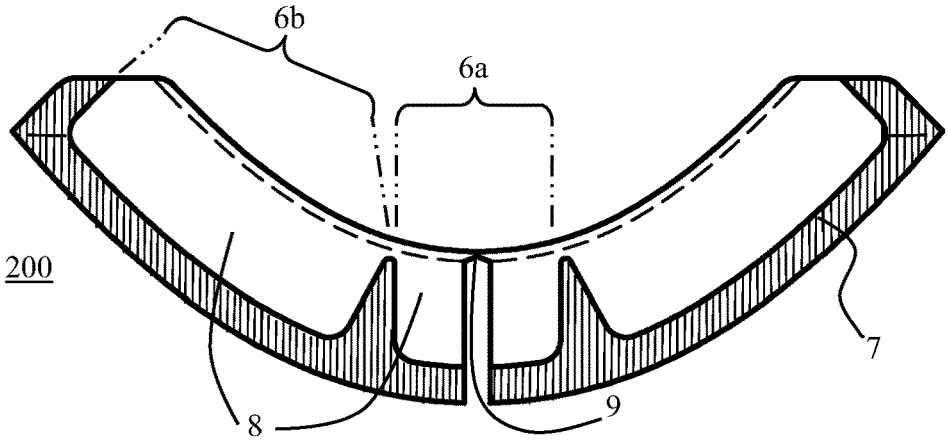
FIG. 11 is a top-down view of the "bottom side" of the bracket of the $2^{nd}$ embodiment.

FIG. 11 shows a bottom view of bracket 200 having a plurality of slots 6, more specifically, a center slot 6*a* that receives a single attachment tab from the prior art device, and two larger slots 6*b*, on the left side (left of center) and right side (right of center) of center slot 6*a*, to receive a plurality of attachment tabs from the prior art device. The center slot 6*a* is split into left and right halves that are connected to a hinge member 9.

As with the slots of bracket 100 described above, the dimensions of each slot 6 are complimentary to the dimensions and thickness of the attachment tabs of the prior art device. Therefore, when the bracket 200 is attached to the toilet seat (with an adhesive material 7 adhered to the bottom surface of bracket 200), the plurality of attachment tabs inserted into slots 6*a* and 6*b*, are flush against the surface of the toilet seat. Similar to the functionality of the tab covers described above for bracket 100, the bottom surface of a plurality of tab covers 8 of the bracket 200, are also in contact with, and apply vertical pressure to, the top surface of the attachment tabs to hold the prior art device against the toilet seat, when the attachment tabs are in their respective slots 6.

Figure 12:
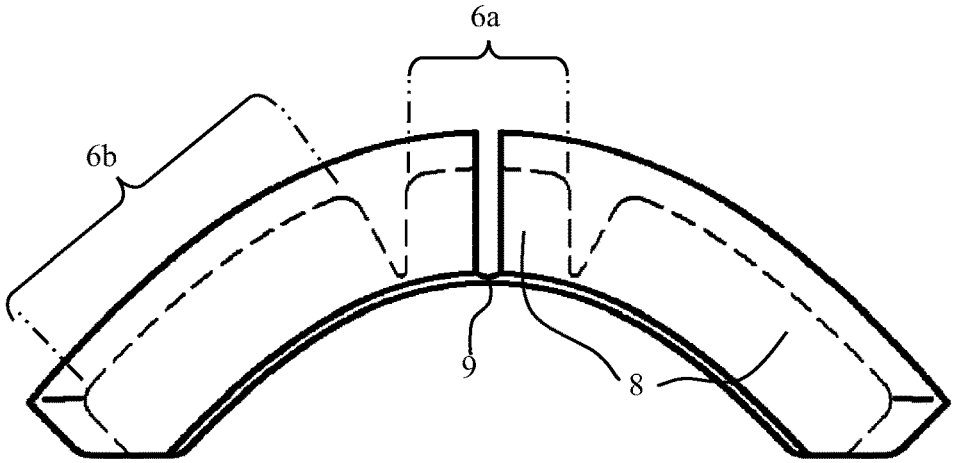
FIG. 12 is a top-down view of the "top side" of the bracket of the $2^{nd}$ embodiment.

FIG. 12 shows a top view of bracket 200, where the tab covers 8 over slots 6*b* are completely covered; and the tab cover over slot 6*a* is segmented, having a left and right half with each segmented side being separated by and attached to hinge member 9.

Figure 13:
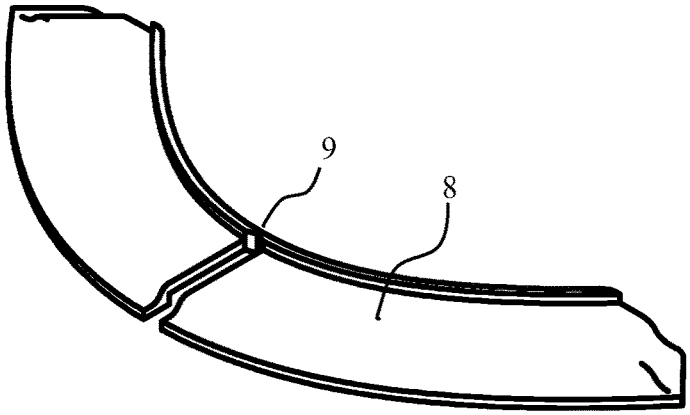
FIG. 13 is a plan view of the bracket of the $2^{nd}$ embodiment.

FIG. 13 shows a plan view of the bracket 200 with the hinge member 9 separating the left and right halves of the bracket 200 and the tab covers 8 completely covering slots 6*b* (not shown) and partially covering slot 6*a* (also not shown).

Figure 14:
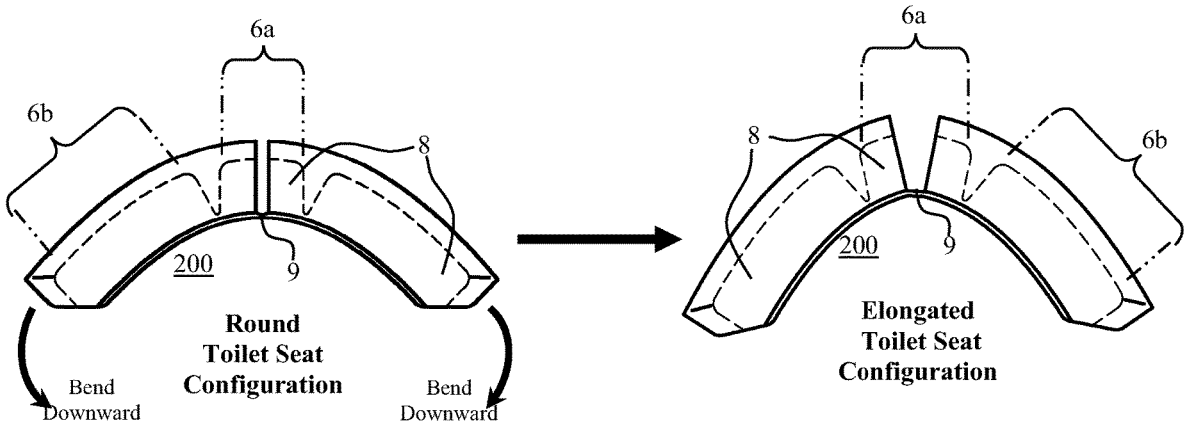
FIG. 14 shows the transformation progression of the bracket of the $2^{nd}$ embodiment from a round toilet seat configuration to an elongated toilet seat configuration.
Figure 15:
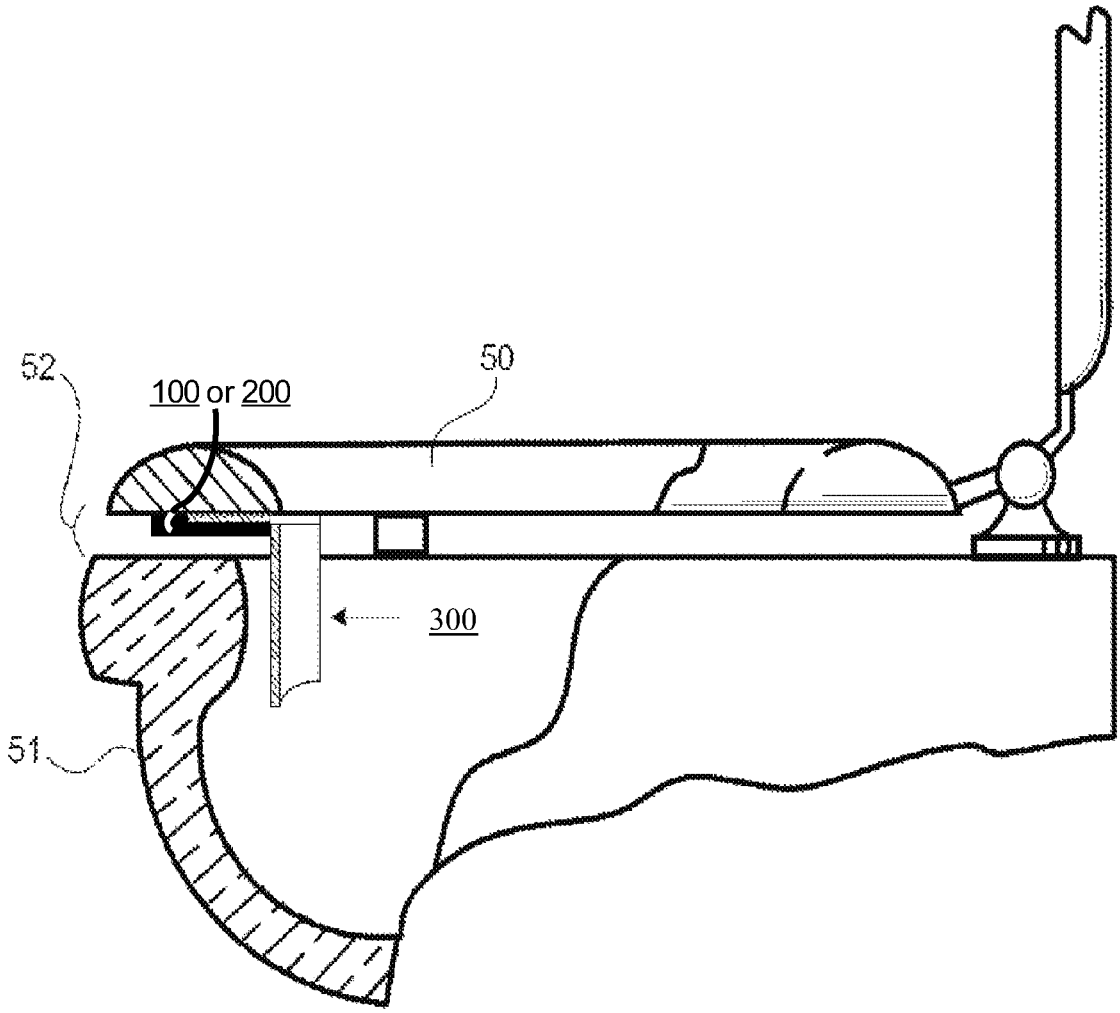
FIG. 15 is a cross-sectional view of the bracket of either the $1^{st}$ embodiment attached to the underside of a toilet seat, as shown in FIG. 7, taken along the line 8-8, and also shown in FIG. 8; and also represents the same cross-sectional view of the bracket of the $2^{nd}$ embodiment as it would appear holding the prior art device against the toilet seat.

As shown in FIGS. 11, 12 and 13, the bracket 200 has a left side and a right side substantially physically separated from each other and connected by a hinge member 9. As shown in FIG. 14, the hinge member 9 allows the left side and right side of bracket 200 to bend to adjust the overall curvature of bracket 200 to conform to the inner curvature of either a standard round or elongated toilet seat. More specifically, in FIG. 14, the bracket 200 (which is manufactured in a configuration to match the curvature of a standard round toilet seat) is manipulated to conform to an elongated toilet seat curvature by bending the left and right tab covers 8 downward until the bracket's 200 curvature matches that of the elongated toilet seat. Once the desired curvature is achieved, bracket 200 can be attached to the toilet seat and received the attachment tabs of the prior art device into bracket 200 slots 6*a* and 6*b*.

The bottom surface of the tab cover 8 can also optionally have the same type of a non-smooth surface shown in FIG. 9 for the bracket 100 of the $1^{st}$ embodiment. More specifically, the bottom surface of tab cover 8 can have plurality of raised structures that press down on the prior art device's plurality of attachment tabs to apply pressure to thereto. Similar to the bracket 100, The plurality of raised structures can have any configuration that exerts pressure against the attachment tabs to hold it in place within the bracket 200 and against the toilet seat. The plurality of raised structures can have the same linear configuration shown in FIG. 10 as 5*a*; or an array of spherical bumps as shown in FIG. 10 as 5*b*. Those of ordinary skill in the art will recognize that the plurality of raised structures as applied to this $2^{nd}$ embodiment of the invention, can have any configuration or arrangement, so long as they provide vertical pressure to the top surface of the prior art device's 300 plurality of attachment tabs to securely hold it against the bottom surface of the toilet seat.

A $3^{rd}$ embodiment of the invention is directed to a method of potty-training wherein the bracket 100 (in either a standard round or elongated configuration) is first attached to the underside of a toilet seat 50. The attachment of the bracket 100 comprises aligning said bracket with the inner curvature of a bottom surface of a toilet seat 50. The plurality of attachment tabs 1 of the prior art device 300 are then inserted into slots 2, thereby positioning the prior art device 300, so that it hangs entirely beneath the underside of the toilet seat 50, in a position to block an opening formed between the toilet seat 50 and a toilet bowl to which said toilet seat 50 is attached, so that the urine-deflecting surface of the prior art device 300 deflects a urine stream directed towards said opening into the toilet bowl.

A $4^{th}$ embodiment of the invention is directed to a method of potty-training wherein the bracket 200 is first attached to the underside of either a standard round or an elongated toilet seat 50, wherein when being attached to an elongated seat, the attachment of the bracket 200 comprises, bending the left side and right side of the bracket 200 to align it with the inner curvature of a bottom surface of a toilet seat 50 and pressing the adhesive 7 on the bottom of bracket 200 against the toilet seat 50. The plurality of attachment tabs of the prior art device are then inserted into slots 6, thereby positioning the prior art device, so that it hangs entirely beneath the underside of the toilet seat 50, in a position to block an opening formed between the toilet seat 50 and a toilet bowl to which said toilet seat 50 is attached, so that the urine-deflecting surface of the prior art device 300 deflects a urine stream directed towards said opening into the toilet bowl.

Once the prior art device 300 is inserted into bracket 100 or bracket 200, it will stay in place until removed for cleaning or replacement. Where the prior art device 300 is removed for cleaning, it can be re-inserted into bracket 100 or bracket 200, without the need for tape to hold the prior art device 300 in place. The prior art device 300 can be removed by pushing the front of the urine deflector at the base of the bracket 100 or bracket 200 away from the slots 2 or slots 5, where they sit, wherein the 'front' of the urine deflector is defined as the surface side that faces away from the toilet or the side of the urine deflector that does not make contact with a urine stream.

The invention has been described in terms of illustrative embodiments. It will be understood by those of ordinary skill in the art that various modifications and changes may be made to these embodiments without departing from the spirit or scope of the invention. It is intended that the invention not be limited in any manner by the embodiments shown and described herein.

What is claimed is:

1. A bracket for securing a potty-training device to an underside of a toilet seat, wherein the potty-training device comprises a plurality of attachment tabs and a urine deflecting surface, said bracket comprising:

a flat, curved portion for affixing the bracket to a flat surface on the underside of said toilet seat;

a plurality of slots formed in said flat, curved portion for inserting said plurality of attachment tabs; and a plurality of tab covers partially covering said plurality of slots, wherein each of said tab covers further comprises a plurality of raised structures on a bottom surface thereof;

wherein when the bracket is affixed to the underside of the toilet seat, and the plurality of attachment tabs are inserted into the plurality of slots, the raised structures on the bottom surface of each of said plurality of tab covers exert vertical pressure on the plurality of attachment tabs securing the attachment tabs and thereby also the potty-training device to the underside of the toilet seat.

2. The bracket according to claim 1, wherein said bracket is adapted to be attached to a standard round toilet seat.

3. The bracket according to claim 1, wherein said bracket is adapted to be attached to an elongated toilet seat.

4. The bracket according to claim 1, wherein the plurality of slots comprise a center slot configured to receive from said potty-training device a single attachment tab, a left of center slot configured to receive from said potty-training device a plurality of attachment tabs, and a right of center slot configured to receive from said potty-training device a plurality of attachment tabs.

5. The bracket according to claim 4, wherein said plurality of tab covers completely or partially cover said plurality of slots.

6. The bracket according to claim 5, wherein said flat curved portion of said bracket further comprises an adhesive material applied thereto, to attach said bracket to the underside of a toilet seat.

7. A method of potty-training comprising:

providing a bracket according to claim 1;

aligning said bracket with the inside curvature of a bottom surface of a toilet seat and attaching said bracket thereto;

attaching a potty-training device comprising a plurality of attachment tabs and a urine deflecting surface to the bracket by inserting said plurality of attachment tabs into said plurality of slots of the bracket, wherein after attaching the potty-training device to the bracket, said potty-training device hangs entirely beneath the underside of said toilet seat in a position to block an opening formed between the toilet seat and a toilet bowl to which said toilet seat is attached so that said urine deflecting surface of the potty-training device deflects a urine stream directed towards said opening into the toilet bowl.

8. A kit for potty-training a child comprising: a bracket according to claim 1; and a means for securing the bracket to an underside of a toilet seat; and optionally a potty-training device, wherein said potty-training device is made of a flexible material, has a flat or an L-shaped configuration, and comprises a plurality of attachment tabs, a urine deflecting surface and a folding seam positioned between and connected to the plurality of attachment tabs on one side and the urine deflecting surface on another side of the folding seam.

9. A bracket for securing a potty-training device to an underside of a toilet seat, wherein the potty-training device comprises a plurality of attachment tabs and a urine deflecting surface, said bracket comprising:

a left side and a right side separated by and connected to a hinge member that allows a curved configuration to bend about the hinge member to conform to an inside curvature of a toilet seat;

a flat, curved portion on said left side and right side of said hinge member for affixing the bracket to a flat surface on the underside of said toilet seat;

a plurality of slots formed in said flat, curved portion for inserting said plurality of attachment tabs; and a plurality of tab covers partially covering said plurality of slots;

wherein when the bracket is affixed to the underside of the toilet seat, and the plurality of attachment tabs are inserted into the plurality of slots, the plurality of tab covers exert vertical pressure on the plurality of attachment tabs securing the attachment tabs and thereby also the potty-training device to the underside of the toilet seat.

10. The bracket according to claim 9, wherein the plurality of slots comprise a center slot configured to receive one or more attachment tabs, a left of center slot configured to a plurality of attachment tabs, and a right of center slot configured to receive a plurality of attachment tabs.

11. The bracket according to claim 10, wherein said plurality of tab covers are contiguous over said left of center slot and said right of center slot; and segmented over said center slot.

12. The bracket according to claim 11, wherein said segmented tab cover over said center slot creates a separation between said left side and said right side of said bracket, allowing said left side and said right side of said bracket to bend about said hinge member.

13. The bracket according to claim 12, wherein said flat curved portion of said bracket further comprises an adhesive material applied thereto, to attach said bracket to the underside of a toilet seat.

14. The bracket according to claim 13, wherein said left side and said right side of said bracket are bent about said hinge member to conform to the inside curvature of an elongated toilet seat.

15. The bracket according to claim 7, wherein said plurality of tab covers further comprise a plurality of raised structures on a bottom surface of said plurality of tab covers, wherein said plurality of raised structures press down on and apply vertical pressure to said plurality of attachment tabs to secure said attachment tabs against the underside of the toilet seat.

16. A method of potty-training comprising:

providing a bracket according to claim 9;

optionally bending said bracket to align it with the inside curvature of a toilet seat;

attaching said bracket to the toilet seat;

attaching a potty-training device comprising a plurality of attachment tabs and a urine deflecting surface to the bracket by inserting said plurality of attachment tabs into said plurality of slots of the bracket, wherein after attaching the potty-training device to the bracket, said potty-training device hangs entirely beneath the underside of said toilet seat in a position to block an opening formed between the toilet seat and a toilet bowl to which said toilet seat is attached so that said urine deflecting surface of the potty-training device deflects a urine stream directed towards said opening into the toilet bowl.

17. A kit for potty-training a child comprising: a bracket according to claim 9; and a means for securing the bracket to an underside of a toilet seat; and optionally a potty-training device, wherein said potty-training device is made of a flexible material, has a flat or an L-shaped configuration, and comprises a plurality of attachment tabs, a urine deflecting surface and a folding seam positioned between and connected to the plurality of attachment tabs on one side and the urine deflecting surface on another side of the folding seam.

* * * * *